US010356875B2

(12) United States Patent
Potucek et al.

(10) Patent No.: US 10,356,875 B2
(45) **Date of Patent: *Jul. 16, 2019**

(54) UNDERWATER LED LIGHT WITH REPLACEMENT INDICATOR

(71) Applicant: Hayward Industries, Inc., Elizabeth, NJ (US)

(72) Inventors: Kevin L. Potucek, Far Hills, NJ (US); James Carter, Warren, RI (US); James Murdock, Wakefield, RI (US); Steven Mitchell, Chepachet, RI (US); Gregory Fournier, West Kingston, RI (US)

(73) Assignee: Hayward Industries, Inc., Elizabeth, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/926,483

(22) Filed: Mar. 20, 2018

(65) Prior Publication Data

US 2018/0213625 A1 Jul. 26, 2018

Related U.S. Application Data

(63) Continuation of application No. 14/208,855, filed on Mar. 13, 2014, now Pat. No. 9,924,577.

(Continued)

(51) Int. Cl.

| | |
|---|---|
| ***H05B 37/02*** | (2006.01) |
| ***H05B 33/08*** | (2006.01) |
| ***H05B 37/03*** | (2006.01) |

(52) U.S. Cl.

CPC ..... *H05B 33/0893* (2013.01); *H05B 33/0842* (2013.01); *H05B 37/0245* (2013.01); *H05B 37/034* (2013.01)

(58) Field of Classification Search

CPC ..... H05B 33/0842; H05B 33/0893; H05B 37/0245; H05B 37/034

(Continued)

(56) References Cited

U.S. PATENT DOCUMENTS

| | | | | |
|---|---|---|---|---|
| 6,348,766 B1 * | 2/2002 | Ohishi | ..... | H05B 33/0893 315/185 R |
| 8,237,381 B2 * | 8/2012 | Harbers | ..... | H05B 33/0803 315/312 |

(Continued)

FOREIGN PATENT DOCUMENTS

WO 2010/030332 A1 3/2010

OTHER PUBLICATIONS

International Search Report dated Jul. 17, 2014, in connection with International Application No. PCT/US14/25905 (3 pages).

(Continued)

*Primary Examiner* — Tung X Le

(74) *Attorney, Agent, or Firm* — McCarter & English, LLP

(57) ABSTRACT

Disclosed is a method of determining depreciation of a lumen output of an LED. More particularly, disclosed is a method of determining depreciation of a lumen output of an LED comprising monitoring, by a processing device, an operating characteristic of an AC power source operatively coupled to the LED; determining, by the processing device, whether a lumen output the LED depreciated beyond a specified lumen value based on the monitoring; and causing, by the processing device, an indicator to provide notification to a user based on determining the lumen output of the LED depreciated beyond the specified lumen value.

29 Claims, 5 Drawing Sheets

Related U.S. Application Data

(60) Provisional application No. 61/790,847, filed on Mar. 15, 2013.

(58) Field of Classification Search
USPC ..... 315/134, 291, 297, 307, 308
See application file for complete search history.

(56) References Cited

U.S. PATENT DOCUMENTS

| | | | | |
|---|---|---|---|---|
| 9,924,577 | B2 | 3/2018 | Potucek et al. | |
| 2002/0140379 | A1* | 10/2002 | Chevalier | H05B 33/0803 315/291 |
| 2005/0184681 | A1 | 8/2005 | Gordin et al. | |
| 2006/0187652 | A1 | 8/2006 | Doyle | |
| 2008/0297068 | A1 | 12/2008 | Koren et al. | |
| 2010/0066260 | A1 | 3/2010 | Newman, Jr. et al. | |
| 2011/0101868 | A1 | 5/2011 | Weiss | |
| 2011/0299068 | A1* | 12/2011 | Glandt | G01J 1/18 356/218 |
| 2013/0088152 | A1 | 4/2013 | Hagen | |
| 2014/0062307 | A1* | 3/2014 | Spencer | H05B 33/0893 315/112 |
| 2014/0119077 | A1 | 5/2014 | Walters et al. | |
| 2014/0225511 | A1 | 8/2014 | Pickard et al. | |
| 2014/0265875 | A1 | 9/2014 | Nelson et al. | |

OTHER PUBLICATIONS

Written Opinion of the International Searching Authority dated Jul. 17, 2014, in connection with International Application No. PCT/US14/235905 (4 pages).
Office Action dated May 13, 2015, issued in connection with U.S. Appl. No. 14/208,855 (9 pages).
Office Action dated Feb. 18, 2016, issued in connection with U.S. Appl. No. 14/208,855 (6 pages).
Office Action dated Oct. 17, 2016, issued in connection with U.S. Appl. No. 14/208,855 (13 pages).
European Search Report dated Oct. 25, 2016, issued in connection with European Patent Application No. 14767893.2 (6 pages).
Notice of Allowance dated Jul. 21, 2017, issued in connection with U.S. Appl. No. 14/208,855 (10 pages).
Notice of Allowance dated Nov. 3, 2017, issued in connection with U.S. Appl. No. 14/208,855 (6 pages).
European Office Action dated Mar. 1, 2019, issued in connection with European Patent Application No. 14767893.2 (6 pages).

* cited by examiner

UNDERWATER LED LIGHT WITH REPLACEMENT INDICATOR

CROSS-REFERENCE TO RELATED APPLICATIONS

This application is a continuation application of, and claims the benefit of priority to, U.S. patent application Ser. No. 14/208,855, filed on Mar. 13, 2014, now U.S. Pat. No. 9,924,577, which claims priority under 35 U.S.C. § 119(e) to U.S. Provisional Patent Application No. 61/790,847, filed Mar. 15, 2013, both of which applications are incorporated herein by reference in their entirety.

BACKGROUND OF THE INVENTION

Field of the Invention

This present disclosure generally relates to underwater lighting systems, and more particularly for lighting systems for use in swimming pools, spas and the like, which provide an indication to a user indicating that at least one of the lights in a lighting system may need to be replaced.

Background of the Invention

In-ground swimming pools and spas are often installed with lights, typically in a horizontal row a short distance below the waterline. The underwater lighting has a pleasing visual effect and permits safe swimming during nighttime.

Commercial pools in most jurisdictions throughout the country and residential pools in some cities or counties have minimum illumination requirements, typically set and enforced by health departments and local building codes, to provide for safe pool use.

Assuming that a specified pool light delivers predictable illumination, in lumen output, pools are designed with the number of lights and niches required to deliver at or above the required illumination, in lumens, for the square footage of the pool surface area. Pools historically have been illuminated with submersible incandescent lights which deliver relatively constant lumen output throughout the life of the incandescent bulb. A typical incandescent bulb has some lumen depreciation in its first 100 hours of use and then maintains a steady state lumen output until the end of its life. Thus, as long as the incandescent bulb is emitting light, the incandescent bulb is emitting the prescribed amount of light.

In contrast, the lumens emitted by LEDs and submersible LED light fixtures depreciate appreciably and predictably over the life of the LEDs. This gradual depreciation over the life of an LED, however, gives no indication as to when the LED will stop delivering a minimum prescribed lumen output for safe illumination of a pool. It is desirable therefore to provide an indication that an LED output has depreciated below a minimum lumen output level.

SUMMARY OF THE INVENTION

Exemplary embodiments of the present disclosure relate to monitoring an operation of LEDs in a light fixture to determine whether the lumen output of the LEDs has depreciated by a specified amount and to provide a user with an indicator to notify the user that the LEDs or the light fixture should be replaced. In exemplary embodiments, a determination that a light fixture or LEDs of the light fixture should be replaced can be based on a total time of operation of the LEDs. A total time of operation or its equivalent can be determined, for example, based on tracking zero-crossing events of an AC power source when the LEDs are energized.

In one embodiment, a method of determining depreciation of a lumen output of an LED assembly is disclosed. The method includes monitoring an operating characteristic associated with an AC power source operatively coupled to the LED assembly and determining whether a lumen output of an LED associated with the LED assembly depreciated beyond a specified lumen value based on the operating characteristic of the AC power source.

In another embodiment, a system for determining depreciation of a lumen output of an LED assembly is disclosed that includes a circuit to monitor an operating characteristic associated with an AC power source operatively coupled to the LED assembly, a non-transitory computer readable storing executable instruction, and a processing device programmed to execute the executable instructions to monitor an operating characteristic associated with an AC power source operatively coupled to the LED assembly and determine whether a lumen output of an LED associated with the LED assembly depreciated beyond a specified lumen value based on the operating characteristic of the AC power source.

In yet another embodiment, an apparatus is disclosed that includes a housing, an LED disposed within the housing, and circuitry disposed within the housing. The circuitry is operatively coupled to the LED and to an AC power source and is configured to monitor an operating characteristic associated with AC power source operatively coupled to the LED assembly and determine whether a lumen output of an LED associated with the LED assembly depreciated beyond a specified lumen value based on the operating characteristic of the AC power source.

In still another embodiment, a non-transitory computer-readable medium storing instruction that are executable by a processing device is disclosed. Execution of the instructions by the processing device cause the processing device to implement a method for determining depreciation of a lumen output of an LED assembly. The method implemented upon execution of the instructions by the processing device includes monitoring an operating characteristic associated with an AC power source operatively coupled to the LED assembly and determining whether a lumen output of an LED associated with the LED assembly depreciated beyond a specified lumen value based on the operating characteristic of the AC power source.

In some embodiments, the operating characteristic of the AC power source can be determined by detecting a zero crossing event of an AC voltage signal provided by the AC power source.

In some embodiments, determining whether a lumen output of an LED associated with the LED assembly depreciated beyond a specified value can include determining a number of zero crossing events occurring when the LED is energized.

In some embodiments, a counter can be implemented to track a number of zero crossing events and the counter can be incremented in response to detection of a zero crossing event.

In some embodiments, a counter value of the counter can be compared to a threshold value and an indicator that the threshold value has been exceeded can be provided.

In some embodiments, the counter value of the counter can be multiplied by half of a period of the AC voltage signal to compute a total time of operation, the total time of operation can be compared to a threshold value, and an indicator that the threshold value has been exceeded can be provided.

In some embodiments, a zero crossing detection circuit can be used to detect a zero crossing event associated with the AC power source.

In some embodiments, the processing device can determine whether a lumen output of an LED associated with the LED assembly depreciated beyond a specified value by determining a number of zero crossing events occurring when the LED is energized.

In some embodiments, the processing device can be programmed to implement a counter to track a number of zero crossing events and to increment the counter in response to detection of a zero crossing event.

In some embodiments, the processing device is programmed to compare a counter value of the counter to a threshold value and provide an indicator that the threshold value has been exceeded.

In some embodiments, the processing device is programmed to multiply the counter value of the counter by half of a period of the AC voltage signal to compute a total time of operation, compare the total time of operation to a threshold value, and provide an indicator that the threshold value has been exceeded.

Any combination or permutation of embodiments is envisioned.

BRIEF DESCRIPTION OF THE DRAWINGS

Important features of the present invention will be apparent from the following Detailed Description of the Invention, taken in connection with the accompanying drawings, in which.

DETAILED DESCRIPTION OF THE INVENTION

Figure 1:
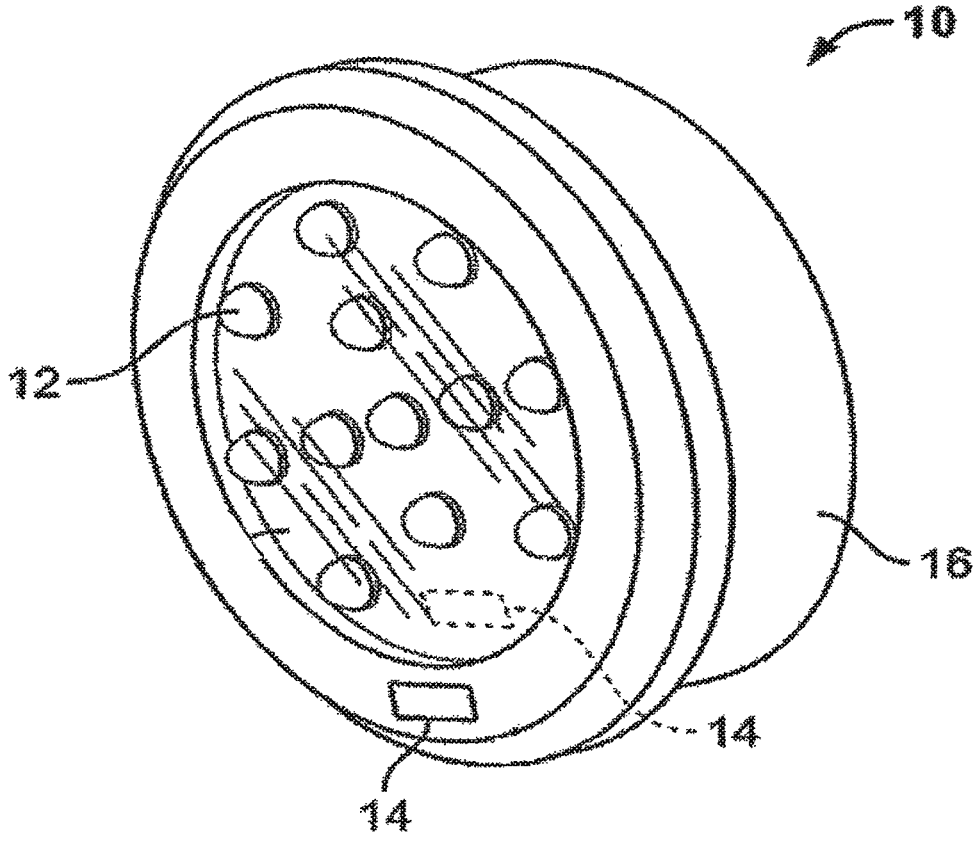
FIG. 1 shows an exemplary light fixture including LED lights and a replacement indicator.

FIG. 1 shows an exemplary light fixture including LED lights and a replacement indicator. The light (or luminaire) fixture 10 includes a housing 16 and one or more light emitting diodes (LEDs) 12 as a light source, and is adapted to be submersed underwater for providing underwater illumination. The light fixture 10 can employ different color LEDs 12 (e.g. red, green, blue, and white LEDs) and can be adapted to generate a variety of different colors, including white light. Desired colors can be obtained by powering various combinations of the LEDs of different primary colors. In some embodiments, a single LED that changes colors can be employed.

In some embodiments, the light fixture 10 can include a replacement indicator 14 for providing a visual indication as to the status of the LEDs 12 (e.g. lumen output level, hours of operation, time to change light). The replacement indicator 14 can be located on the housing 16 or within the housing 16. Depending on the status of the lumen output, the replacement indicator 14 can employ a particular color output out of a plurality of different color outputs. The status of the lumen output can be determine based on a total time (e.g., milliseconds, seconds, minutes, hours, etc.) of operation of the light fixture (e.g., a total amount of time that the LEDs 12 have been on since being installed). For example, the replacement indicator 14 could provide a green color light when the total time of operation is below a minimum threshold level, and the replacement indicator 14 could provide a red color light when the total time of operation exceeds the minimum threshold (e.g., to indicate that the light fixture 10 is due for replacement). In addition or as an alternative to the visual indication, the replacement indicator 14 could comprise an audible indication to alert a user of a need to replace the light fixture 10.

The LEDs 12 themselves can provide a visual status indicator. For example, in response to determining that the LEDs 12 should be replaced (e.g., based on determining that the total time of operation exceeds a threshold level), the LEDs 12 can blink (e.g., turn off and on) for a specified period of time when the LEDs 12 are first turned on and/or can periodically blink (e.g., turn off and on) at a specified time interval while the LEDs 12 are in operation. A visual status indicator can be provide through a combination of the LEDs 12 and replacement indicator 14.

Figure 2:
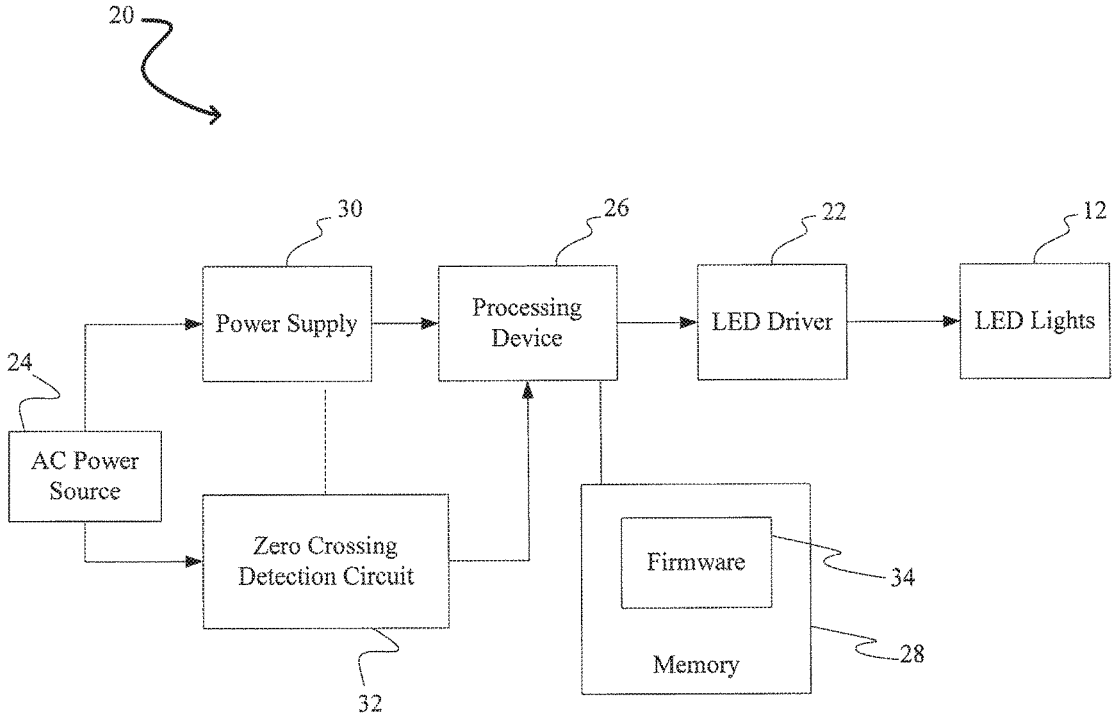
FIG. 2 is a block diagram showing components of an exemplary circuit configured to implement the replacement indicator.

FIG. 2 is a block diagram showing components of an exemplary circuit configured to implement the replacement indicator;. The circuit 20 can be incorporated into the housing of the light fixture 10. Portions of the circuit 20 can be external to the light fixture 10. The circuit 20 includes the LEDs 12, LED drivers 22, a processing device 26 (e.g., a microprocessor, controller, microcontroller, etc.), memory 28 (e.g., one or more non-transitory computer-readable media storage devices), a power supply 30, and a zero cross detection circuit 32.

The LEDs 12 can be operatively coupled to the processing device 26 via one or more LED drivers 22, which are operative to turn the LEDs 12 on or off in response to an output of the processing device 26. The power supply 30 can be configured to receive AC voltage from an AC power source 24 (e.g., a 120V or 240V AC signal having a frequency of 60 Hz) and to convert the AC voltage signal to a DC voltage, which can be fed to the processing device 26 to power the processing device 26.

The processing device 26 can also be operatively coupled to the memory 28, which can store firmware 34 that can be executed by the processing device 26 to control an operation of the circuit 20. The firmware 34 can include executable code and/or instructions for implementing a replacement indicator program to determine when at least one of the LEDs 12 should be replaced, as described in more detail below. The firmware 34 can also include executable code and/or instructions for controlling a normal operation of the LEDs 12.

The zero crossing detection circuit 32 can be operatively coupled between the AC power source 24 and the processing device 26. The zero crossing detection circuit 32 can receive AC voltage from the power source 24 and can be configured to determine each time the AC voltage signal crosses zero voltages. In response to detecting that a zero crossing event has occurred (i.e., the AC voltage signal transitioned from a negative voltage to a positive voltage or vice versa), the zero crossing detection circuit 32 can output a zero crossing detection signal to the processing device 26. The zero crossing detection signal can be implemented as a digital binary signal that is high (e.g., '1') in response to detection of a zero crossing and is otherwise low (e.g., '0'), or vice versa. Those skilled in the art will recognize that the zero crossing detection signal can take on any of several forms.

Since the AC voltage signal is periodic (e.g., having an operating frequency of 60 Hz), the zero cross detection circuit 32 can detect a zero crossing event twice for each period of the AC voltage signal approximately. For example, for an AC voltage signal operating at 60 HZ, the zero detection circuit 32 can detect a zero crossing approximately every 8.33 milliseconds (every half period of the sinewave). By detecting zero crossing events, the present disclosure can advantageously determine an amount of time the LEDs 12 are energized (e.g., turned 'on') or de-energized (e.g., turned 'off'), for example, by tracking the number of zero crossings detected by the zero crossing detection circuit 32, and by monitoring whether the LEDs 12 are 'on' or 'off', as described in more detail below.

Those skilled in the art will recognize that the zero crossing detection circuit 32 can directly process voltage from the AC power source 24 and/or can process a signal that corresponds to and/or is associated with the voltage from the AC power source 24. For example, the power supply 30 can provide the zero crossing detection circuit 32 with a conditioned power signal, which the zero crossing detection circuit 32 can use to detect zero crossing events associated with the AC voltage signal provided by the AC power source. For example, the zero crossing detection circuit 32 can receive a reduced voltage signal (a voltage signal having amplitude of 3 volts, 5 volts, 6 volts, etc.) corresponding to the AC voltage signal, which can have an amplitude of, for example, 120 volts or 240 volts.

As discussed above, the processing device 26 can be configured to control an operation of the LEDs 12 and/or the replacement indicator 14. For example, the processing device 26 can control an operation of the LEDs 12 and/or the replacement indicator 14 according to the firmware 34 stored in the memory 28 and/or according to one or more control signals received from a remote controller or a control system. Portions of the circuit 20 can be implemented as part of the remote controller or control system.

The processing device 26 can execute the firmware 34 to monitor the output of the zero crossing detection circuit 32 (e.g., the zero crossing detection signal) when the LEDs 12 are operating (e.g., turned on). Conversely, when the LEDs 12 are not operating (e.g., turned off) the processing device 26 can be programmed (e.g., according to the firmware 34) to ignore the zero detection output signal provided by the zero crossing detection circuit. In some embodiments, the processing device 26 can be programmed (e.g., according to the firmware 34) to monitor the output of the zero crossing detection circuit 32 when the LEDs 12 are both operating and are not operating.

The processing device 26 can be programmed (e.g., according to the firmware 34) to implement a counter to track a number of zero crossings detected by the zero crossing detection circuit. In one embodiment, the processing device 26 can be programmed to increment the counter when the LEDs 12 are turned on for each zero crossing event detected by the zero crossing detection circuit 32, for every other zero crossing event detected, and/or after a specified number of zero crossing events have occurred since the last time the counter was incremented. Using the counter value maintained by the counter, the processing device 26 can be programmed to determine a total amount of time that the LEDs 12 have been 'on' since the LEDs 12 and/or the light fixture 10 were installed.

The processing device 26 can be programmed to multiply the counter value by a stored value corresponding to the time period between incrementing the counter. For example, the counter can be incremented every time a zero crossing is detected when the LEDs 12 are 'on', and the processing device 26 can multiply the counter value by half the period of the AC voltage signal to obtain a total time (e.g., milliseconds, seconds, minutes, hours, etc.) of operation of the LEDs 12. As another example, the counter can be incremented every other time a zero crossing is detected when the LEDs 12 are 'on', the processing device 26 can multiply the counter value by the period of the AC voltage signal to obtain a total time of operation of the LEDs 12.

The processing device 26 can compare the counter value and/or a total time of operation to a threshold value. The threshold value can correspond to a counter value and/or a quantity of time that correlates to an estimated percent depreciation of the lumen output from the LEDs 12, for example, an estimated percentage depreciation for which the lumen output is no longer acceptable (e.g., does not satisfy jurisdictional requirements). In exemplary embodiments, lumen output of the LEDs 12 can be predictable over the life of the LEDs 12 such that the total time of operation (or the counter value itself) can be correlated to the lumen out of the LEDs 12. The threshold value can be a fixed value or can be adjustable (e.g., by the user or the processing device 26).

In response to determining that the counter value and/or the total time of operation of the LEDs 12 exceed the threshold value, the processing device 26 can be programmed (e.g., according to the firmware 34) to implement one or more indicators that indicate the LEDs 12 should be replaced. For example, the processing device 26 can control the output of the replacement indicator 14 (e.g., cause the replacement indicator 14 to output a red light) and/or can control the operation of the LEDs 12 (e.g., cause the LEDs 12 to blink).

Figure 3:
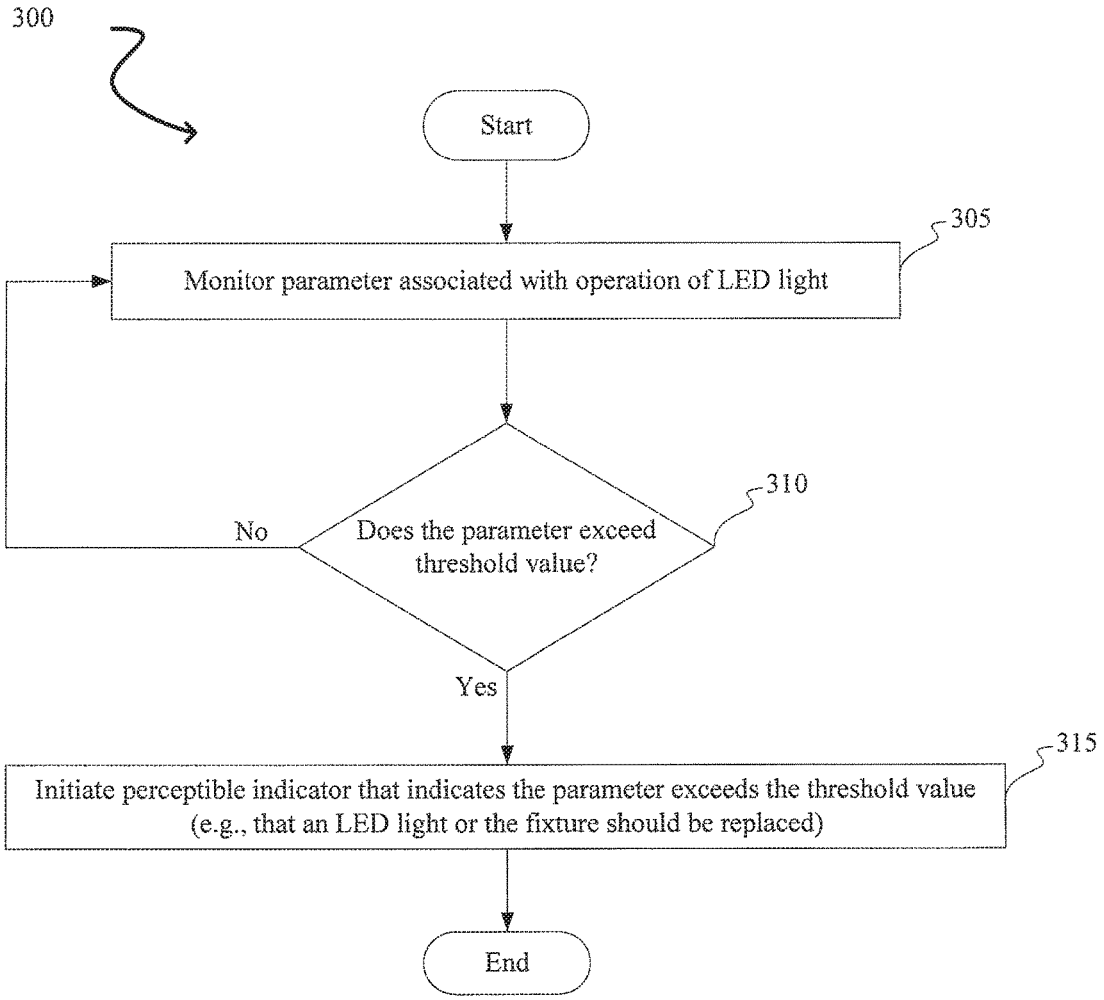
FIGS. 3-4 are flowcharts of processing steps carried out by the system for monitoring when an LED light should be replaced.

FIG. 3 is a flowchart showing processing steps carried out by the system for monitoring when an LED light should be replaced The firmware 34 can include code and/or instructions, and the processing device 26 can execute the code and/or instructions to carry out a light replacement indicator process 300 as shown in FIG. 3. In step 305, when power is applied to light fixture 10, the processing device 26 monitors a parameter associated with operation of the LEDs 12. The parameter monitored can be, for example, total time of operation of the LEDs 12, which can be used to determine an amount of lumen output depreciation of the LEDs 12, as described herein. In step 310, microprocessor 26 determines if the parameter monitored exceeds a threshold level. As an example, the threshold level can be a specified total time of operation corresponding to a predetermined lumen depreciation of the LEDs 12. If the threshold is not exceeded, the processing device 26 continues to monitor the parameter. If the threshold is exceeded, the processing device 26 initiates a perceptible indicator that indicates the parameter exceeds the threshold level. The threshold level can be user adjustable, predetermined, etc., depending on the application and parameter measured.

Figure 4:
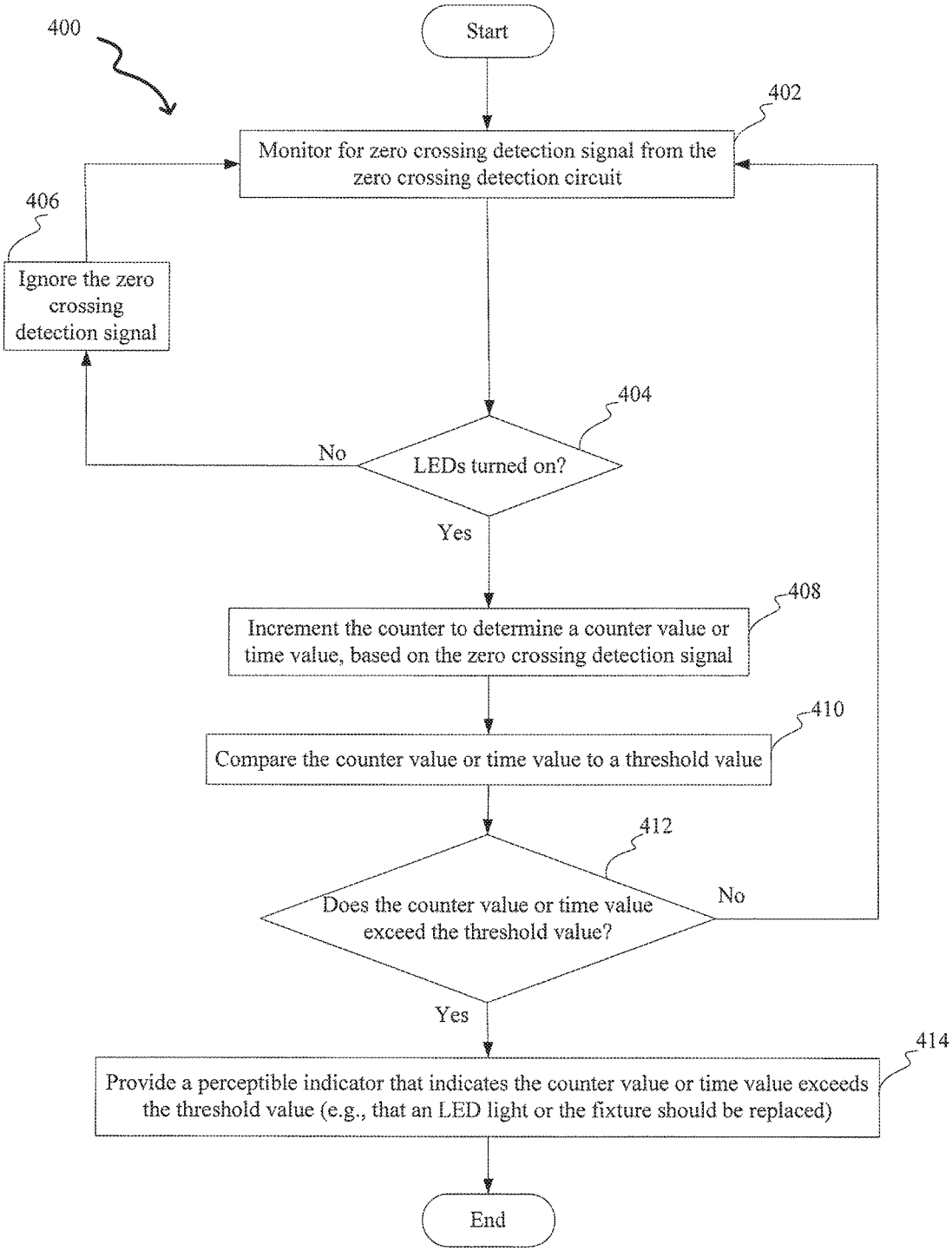

FIG. 4 is another flowchart showing processing steps carried out by the system for monitoring when an LED light should be replaced. The firmware 34 can include code and/or instructions, and the processing device 26 can execute the code and/or instructions to carry out a light replacement indicator process 400 as shown in FIG. 4. In step 402, the processing device 26 can monitor for zero crossing events based on a zero crossing detection signal received from the zero crossing detection circuit 32. When a zero crossing event is detected, the processing device 26 can determine whether the LEDs are 'on' or 'off' at step 404. If the LEDs 12 are 'off', then in step 406, the processing device 26 can ignore the zero crossing event and can continue to monitor for zero crossing events. If the LEDs 12 are 'on', then in step 408, the processing device 26 can increment a counter. In step 410, in response to the detection of a zero crossing event at step 408, the processing device 26 can compare the counter value or time value corresponding to the counter value to a threshold value. In step 412, the processing device 26 determines whether the counter value or the time value exceeds a threshold value. If, in step 412, the processing device 26 determines the counter value or the time value does not exceed the threshold value, then the processing device 26 returns to step 402 and can continue monitoring for zero crossing events. If, in step 412, the processing device 26 determines the counter value or time value exceeds the threshold value, then in step 414 the processing device 26 can provide a perceptible indicator that indicates the parameter exceeds the threshold level and that the LED fixture 10 or LEDs 12 should be replaced.

Figure 5A:
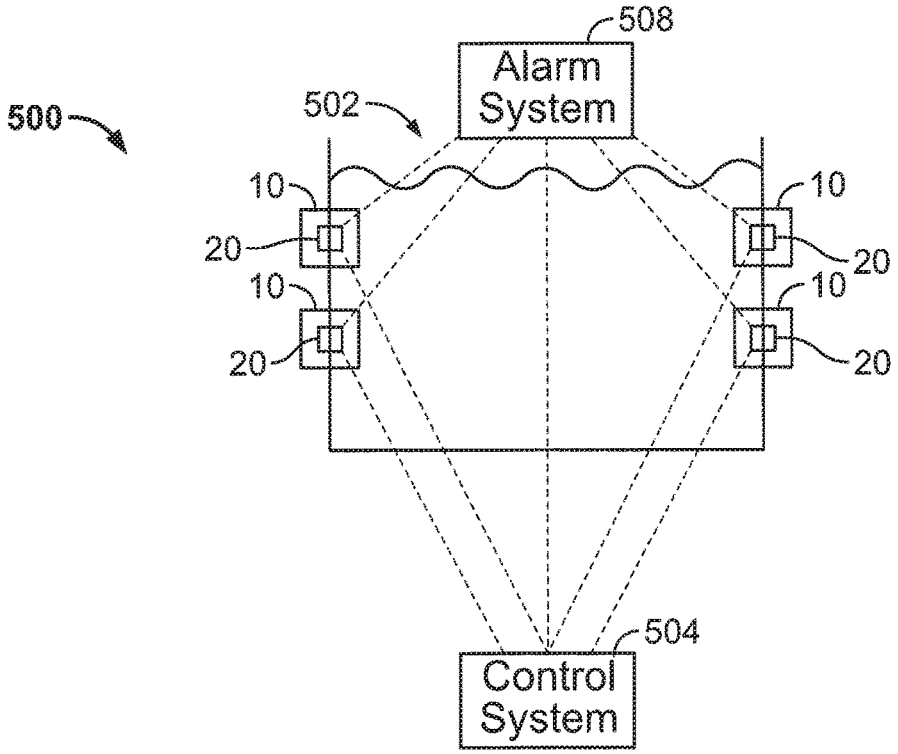
FIGS. 5A-5B are schematic representations of pool lighting systems including light fixtures and circuitry for implementing replacement indicators.
Figure 5B:
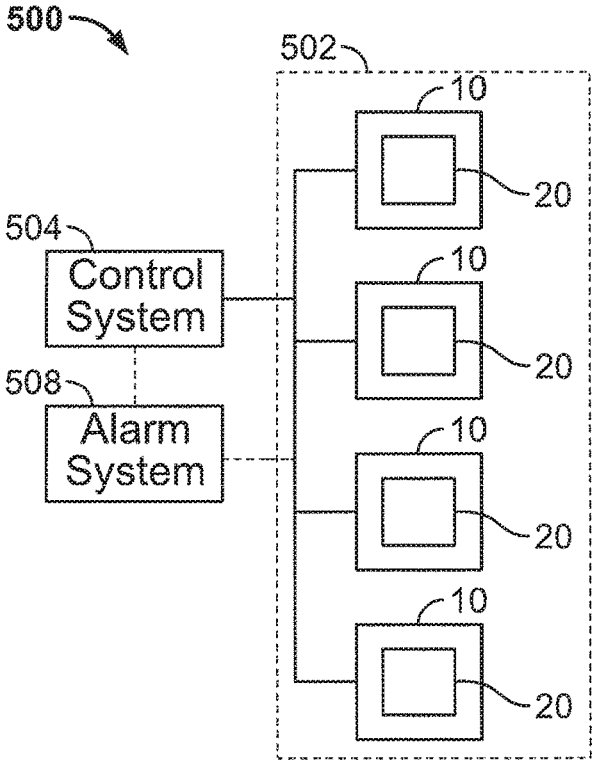

FIGS. 5A-5B are schematic representations of pool lighting systems including light fixtures and circuitry for implementing replacement indicators. FIGS. 5A-5B each shows an exemplary pool lighting system 500 including light fixtures 10 disposed in a swimming pool 502 below the water line. The pool lighting system 500 can be part of a pool or home automation system and/or can be a stand-alone system. The light fixtures 10 can include the circuit 20, which can communicate with a remote or central control system 504, which can operate to control the pool lighting system 500 as well as other systems (e.g., fluid circulation system of the pool, other lighting systems, etc.). For example, the control system 504 can provide one or more signals to the circuit 20 (e.g., from the processing device 26) of the light fixtures 10 and/or can receive one or more signals from the circuit 20 (e.g., the processing device 26) of the light fixture 10. The signals sent to the light fixture can include commands, messages, and/or instruction that can be used by the circuit 20 to determine when to energize the LEDs of each fixture 10 and when to de-energize the LEDs of each fixture 10. Each fixture can be independently controllable by their respective circuit and/or can be controlled collectively. The circuits 20 of the fixtures 10 can be programmed to communicate with the control system 504 using wired or wireless communication.

The lighting system 500 can include an alarm 508 that can be controlled by each of the circuits 20 and/or by the control system 504. For example, the circuit 20 can send a signal to the alarm when an unacceptable lumen depreciation has been identified and the alarm can generate a visual and/or audible alarm (e.g., lights and/or sound) to notify the user that one of the fixtures 10 or LEDs within the fixtures 10 should be replaced (see, e.g., FIG. 5A). As another example, the circuit 20 can communicate with the control system 504 to notify the control system 504 that an unacceptable lumen depreciation has been identified and the control system 504 can activate the alarm system 508 (see, e.g., FIG. 5B). The alarm system 508 can indicate which of the fixtures 10 caused the alarm. As described above, each fixture 10 can also provide notification to the user that an unacceptable lumen depreciation has been identified (e.g., using the replacement indicator 14 and/or by blinking the LEDS according to a specified pattern).

While the circuit 20 has been described as being incorporated in to the fixture 10 in FIGS.5A-5B, those skilled in the art will recognize that portions of the circuit may be external of the fixture 10 and/or may be incorporated into the control system 504. Furthermore, while the alarm system 508 is shown as being separate from the control system 504, those skilled in the art will recognize that the alarm system 508 can be incorporated into the control system 504.

While exemplary embodiments have been described with respect to incrementing a counter and exceeding a threshold value, those skilled in the art will recognize that exemplary embodiments of the present disclosure can be implemented to decrease a counter and/or determine whether the counter value or corresponding time value is at or below the threshold. For example, the counter can be set to an initial value and can be decremented each time a zero crossing event is detected when the LEDs 12 are 'on'. When the counter value reaches zero, the processing device 26 can be programmed to provide a perceptible indicator that the parameter exceeds the threshold level and that the LED fixture 10 or LEDs 12 should be replaced.

Having thus described the system and method in detail, it is to be understood that the foregoing description is not intended to limit the spirit or scope thereof. It will be understood that the embodiments of the present disclosure described herein are merely exemplary and that a person skilled in the art may make any variations and modification without departing from the spirit and scope of the disclosure. All such variations and modifications, including those discussed above, are intended to be included within the scope of the disclosure. What is desired to be protected by Letters Patent is set forth in the following claims.

What is claimed is:

1. A method of determining a status of an LED of an underwater lighting fixture, comprising:

monitoring, by a processing device, an operating characteristic of an AC power source operatively coupled to the LED of the underwater lighting fixture;

determining, by the processing device, a status of the LED of the underwater lighting fixture based on the operating characteristic of the AC power source; and causing, by the processing device, an indicator to provide notification to a user based on the status of the LED of the underwater lighting fixture.

2. The method of claim 1, wherein the status is a lumen output level of the LED, a time of operation of the LED, or whether the LED is due for replacement.

3. The method of claim 1, wherein the monitoring step comprises detecting zero crossing events of an AC voltage signal provided by the AC power source.

4. The method of claim 1, wherein the determining step comprises counting a number of zero crossing events of an AC voltage signal provided by the AC power source that occur when the LED is energized; and comparing the counted number of zero crossing events to a threshold value.

5. The method of claim 4, wherein the threshold value is based on a specified total time of operation corresponding to a predetermined lumen depreciation of the LED.

6. The method of claim 5, wherein if the counted number of zero crossing events is less than the threshold value then the indicator provides notification to the user that the LED is not due for replacement.

7. The method of claim 5, wherein if the counted number of zero crossing events is greater than the threshold value then the indicator provides notification to the user that the LED is due for replacement.

8. The method of claim 1, wherein the determining step comprises counting a number of zero crossing events of an AC voltage signal provided by the AC power source that occur when the LED is energized; multiplying the counted number by half of a period of the AC voltage signal to compute a total time of operation; and comparing the total time of operation to a threshold value.

9. The method of claim 1, wherein causing the indicator to provide notification comprises at least one of causing the LED to blink on and off, or causing a replacement indicator light to shine a red light.

10. The method of claim 1, wherein the LED is one of a plurality of LEDs disposed in the underwater lighting fixture.

11. The method of claim 1, wherein the processing device is connected to the LED via a control system through at least one of a wired connection or a wireless connection.

12. An apparatus, comprising:

a housing;

an LED disposed within the housing; and a processor operatively coupled to the LED and to an AC power source, the processor configured to:

monitor an operating characteristic of the AC power source operatively coupled to the LED;

determine a status of the LED based on the operating characteristic of the AC power source; and cause an indicator to provide notification to a user based on the status of the LED.

13. The apparatus of claim 12, wherein the status is a lumen output level of the LED, a time of operation of the LED, or whether the LED is due for replacement.

14. The apparatus of claim 12, wherein the processor determines the status of the LED based on counting a number of zero crossing events of an AC voltage signal provided by the AC power source that occur when the LED is energized; and comparing the counted number of zero crossing events to a threshold value.

15. The apparatus of claim 14, wherein the threshold value is based on a specified total time of operation corresponding to a predetermined lumen depreciation of the LED.

16. The apparatus of claim 14, wherein if the counted number of zero crossing events is less than the threshold value then the indicator provides notification to the user that the LED is not due for replacement.

17. The apparatus of claim 14, wherein if the counted number of zero crossing events is greater than the threshold value then the indicator provides notification to the user that the LED is due for replacement.

18. The apparatus of claim 12, wherein the processor causes the indicator to provide notification by at least one of causing the LED to blink on and off, or causing a replacement indicator light to shine a red light.

19. The apparatus of claim 12, wherein the housing comprises a light fixture submersible under water.

20. The apparatus of claim 12, wherein the processor is connected to the LED via a control system through at least one of a wired connection or a wireless connection.

21. An LED replacement indicator comprising a memory and a processor, the memory storing non-transitory computer-readable medium that, when executed by the processor, cause the processor to, monitor an operating characteristic of an AC power source operatively coupled to an LED;

determine a status of the LED based on the operating characteristic of the AC power source; and cause an indicator to provide notification to a user based on the status of the LED.

22. The LED replacement indicator of claim 21, wherein the status is a lumen output level of the LED, a time of operation of the LED, or whether the LED is due for replacement.

23. The LED replacement indicator of claim 21, wherein the processor determines the status of the LED based on counting a number of zero crossing events of an AC voltage signal provided by the AC power source that occur when the LED is energized; and comparing the counted number of zero crossing events to a threshold value.

24. The LED replacement indicator of claim 23, wherein the threshold value is based on a specified total time of operation corresponding to a predetermined lumen depreciation of the LED.

25. The apparatus of claim 23, wherein if the counted number of zero crossing events is less than the threshold value then the indicator provides notification to the user that the LED is not due for replacement.

26. The apparatus of claim 23, wherein if the counted number of zero crossing events is greater than the threshold value then the indicator provides notification to the user that the LED is due for replacement.

27. The LED replacement indicator of claim 21, wherein the processor causes the indicator to provide notification by at least one of causing the LED to blink on and off, or causing a replacement indicator light to shine a red light.

28. The LED replacement indicator of claim 21, comprising an underwater lighting fixture.

29. The LED replacement indicator of claim 21, wherein the processor is connected to the LED via a control system through at least one of a wired connection or a wireless connection.

* * * * *